US007071929B2

(12) United States Patent
Fujii

(10) Patent No.: US 7,071,929 B2
(45) Date of Patent: Jul. 4, 2006

(54) METHOD OF DRIVING LIQUID CRYSTAL DISPLAY AND LIQUID CRYSTAL DISPLAY USING THE DRIVING METHOD

(75) Inventor: Gen Fujii, Tokyo (JP)

(73) Assignee: NEC Corporation, Tokyo (JP)

( * ) Notice: Subject to any disclaimer, the term of this patent is extended or adjusted under 35 U.S.C. 154(b) by 391 days.

(21) Appl. No.: 10/377,876

(22) Filed: Mar. 4, 2003

(65) Prior Publication Data

US 2003/0164813 A1 Sep. 4, 2003

(30) Foreign Application Priority Data

Mar. 4, 2002 (JP) ..... 2002-057274

(51) Int. Cl.
*G09G 3/34* (2006.01)

(52) U.S. Cl. ..... 345/204; 345/87; 345/89; 345/90; 345/92; 345/94; 345/99; 345/101; 345/208; 345/210

(58) Field of Classification Search ..... 345/87, 345/89, 90, 92, 94, 99, 101, 204, 208, 210
See application file for complete search history.

(56) References Cited

U.S. PATENT DOCUMENTS 5,705,411 A * 1/1998 Yamanobe et al. ..... 438/158
6,243,061 B1 * 6/2001 Sandoe et al. ..... 345/91
2001/0040543 A1 * 11/2001 Lee ..... 345/87
2001/0040546 A1 * 11/2001 Ohmuro et al. ..... 345/87
2002/0008688 A1 1/2002 Yamamoto et al.
2002/0158830 A1 * 10/2002 Kondoh et al. ..... 345/96

FOREIGN PATENT DOCUMENTS

JP 4-142592 A 5/1992
JP 2000-338518 A 12/2000

* cited by examiner

*Primary Examiner*—Ricardo Osorio
*Assistant Examiner*—Vincent E. Kovalick
(74) *Attorney, Agent, or Firm*—Sughrue Mion, PLLC

(57) ABSTRACT

In a method of driving an active matrix liquid crystal display according to pulse width modulation driving system using a thin-film transistor for a switching device, the variation of the temperature of a liquid crystal display panel is monitored. Particularly, the panel temperature detecting means of the liquid crystal display panel is provided, and gate-on voltage or data signal pulse width and a frequency of a reference clock signal are corrected according to the temperature of the panel. The corrected quantity of gate-on voltage according to the polarity of write data or the corrected quantity of data signal pulse width is determined according to the temperature of the panel. The higher the temperature of the panel is, to the lower value the positive or negative gate-one voltage is set and the lower the temperature of the panel is, to the higher value the positive or negative gate-on voltage is set. Positive gate-on voltage is set so that it is always higher than negative gate-on voltage.

18 Claims, 4 Drawing Sheets

FIG. 3A
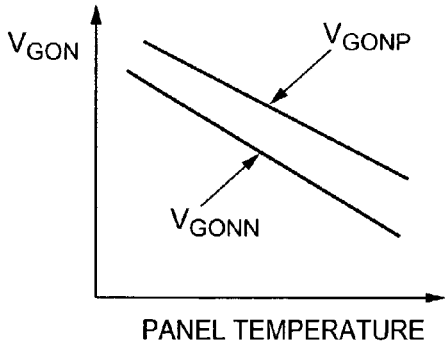
FIG. 3B
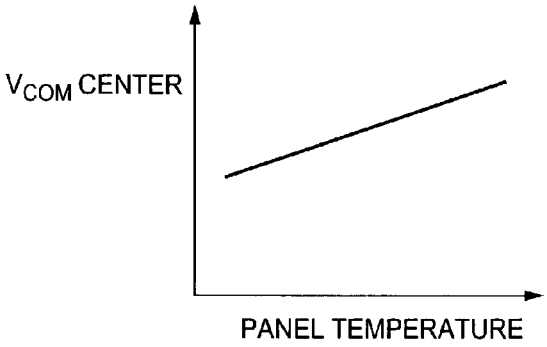
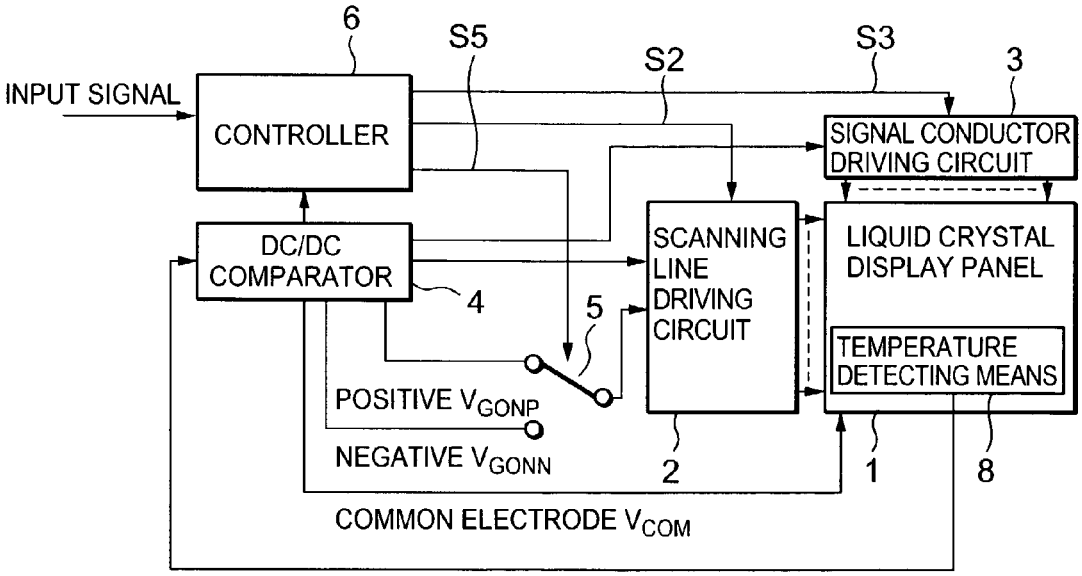
FIG. 4

METHOD OF DRIVING LIQUID CRYSTAL DISPLAY AND LIQUID CRYSTAL DISPLAY USING THE DRIVING METHOD

BACKGROUND OF THE INVENTION

1. Field of the Invention

The present invention relates to a method of driving an active matrix liquid crystal display, particularly relates to a method of driving a liquid crystal display according to a pulse width modulation driving system in which a thin-film transistor is used for a switching device and a liquid crystal display driven by the driving method.

2. Description of the Prior Art

An active matrix liquid crystal display that executes gradation display according to a pulse width modulation (PWM) system is known. In a method of driving the liquid crystal display according to the PWM system, display according to each gradation is realized by not varying a level of gradation voltage applied to a display pixel according to displayed gradation but varying duration in which voltage is applied according to displayed gradation. In the liquid crystal display according to the PWM driving system, the number of display gradations can be increased, using a gradation voltage generating circuit having simple configuration.

Such a method of driving the liquid crystal display according to the PWM driving system proposed in Japanese published unexamined patent application No. Hei4-142592 will be described as an example below. FIG. 6 is a block diagram showing a main part of a conventional type liquid crystal display.

The conventional type liquid crystal display is provided with plural scanning lines 101 and plural signal conductors 102 respectively crossing each other, plural pixel electrodes 103 arrayed in parts in which these are crossed, a liquid crystal display panel 100 where each thin-film transistor 104 which is connected to each pixel electrode and which executes switching operation when a gate signal is sent to the corresponding scanning line 101 and a data signal is sent to the corresponding signal conductor 102 is formed, a scanning line driving circuit 105 that applies a gate signal to the plural scanning lines 101 and a signal conductor driving circuit 106 that sends a data signal applied to each pixel to the plural signal conductors 102. The scanning line driving circuit 105 sequentially selects plural scanning lines 101 in one vertical term, turns on plural thin-film transistors, and the signal conductor driving circuit 106 applies a data signal to each of plural pixel electrodes 103 connected to each of the turned-on plural transistors only in a term of pulse width determined according to displayed gradation.

FIG. 7 is a timing chart showing the variation of applied voltage $V_P$ applied to a certain pixel electrode 103 of the liquid crystal display according to the PWM driving system shown in FIG. 6. When a gate signal $V_G$ applied to the scanning line 101 is turned at a high level $V_{GH}$ while a data signal $V_D$ applied to the signal conductor 102 in a certain one vertical term (1V) is at a reference level, the thin-film transistor 104 is turned on, applied voltage $V_P$ is increased in accordance with the data signal $V_D$ and further, when the data signal $V_D$ is turned at a positive active level, the applied voltage $V_P$ is increased in accordance with the data signal only in a term $T_{W1}$ of pulse width determined according to displayed gradation. Next, when the gate signal $V_G$ is turned at a low level $V_{GL}$, the thin-filmtransistor 104 is turned off and applied voltage $V_P$ at this time is held. When the gate signal $V_G$ applied to the scanning line 101 is turned at a high level $V_{GH}$ while the data signal $V_D$ applied to the signal conductor 102 in the next one vertical term is at the reference level, the thin-filmtransistor 104 is turned on, applied voltage $V_P$ is decreased in accordance with the data signal $V_D$ and further, when the data signal $V_D$ is turned at a negative active level, applied voltage $V_P$ is decreased in accordance with the data signal $V_D$ only in a term $T_{W2}$ of pulse width determined according to the displayed gradation. Next, when the gate signal $V_G$ is turned at a low level $V_{GL}$, the thin-firm transistor 104 is turned off and applied voltage $V_P$ at this time is held. As described above, multi-gradation display is realized, using the gradation voltage generating circuit having simple configuration by turning the data signal at the active level only in pulse duration according to displayed gradation.

In the Japanese published unexamined patent application No. Hei4-142592, to prevent voltage applied to a pixel electrode and having data polarity for writing from being asymmetrical and to prevent flickering and burning from being caused, it is also proposed that if gate-on voltage in case a data signal is negative is $V_{GONN}$ and gate-on voltage in case the data signal is positive is $V_{GONP}$, $V_{GONN}$ is set so that it is lower than $V_{GONP}$.

By the way, the temperature and the display characteristic of the liquid crystal display panel of such a liquid crystal display according to the PWM driving system will be reviewed below. The ON state-current of each thin-film transistor which is connected to each pixel electrode and which executes switching operation depends upon the temperature of the panel and as the temperature of the panel rises, the ON-state current increases. As voltage applied to a liquid crystal is proportional to the product of the ON-state current and data signal pulse width, the displayed gradation-luminance characteristic of the liquid crystal display panel varies according to the temperature of the panel. Therefore, when the temperature of the panel varies, the display image quality of the liquid crystal display panel varies. Besides, as the electric characteristics of the thin-film transistor depend upon the temperature of the panel, the asymmetric property of writing quantity according to data polarity is different depending upon the temperature of the panel and when the temperature of the panel varies, flickering and burning are caused.

SUMMARY OF THE INVENTION

Therefore, the object of the invention is to provide a method of driving a liquid crystal display according to a PWM system and the liquid crystal display driven according to the driving method respectively in which the variation of a displayed gradation-luminance characteristic and the burning of a liquid crystal display panel respectively due to the variation of the temperature of the panel can be inhibited.

According to the invention, the method of driving the active matrix liquid crystal display and the liquid crystal display driven by the driving method respectively characterized in that panel temperature detecting means is provided, gate-on voltage or data signal pulse width and a frequency of a reference clock signal are corrected according to the temperature of the panel and the corrected quantity of gate-on-voltage according to the polarity of write data or the corrected quantity of data signal pulse width is determined according to the temperature of the panel based upon a method of driving an active matrix liquid crystal display driven according to a pulse width modulation system using a thin-film transistor for a switching device are acquired.

The invention is based upon a liquid crystal display according to a pulse width modulation driving system using a thin-film transistor for a switching device and a method of driving it and is also characterized in that voltage applied to a liquid crystal is corrected according to the polarity of write data, considering the temperature of a liquid crystal display panel.

In one of the characteristics, a liquid crystal is driven, correcting gate-on voltage according to relation according to the temperature of a panel shown in a graph in FIG. 3A. That is, a DC/DC converter 4 sets according to a control signal from a temperature detecting circuit 7 shown in FIG. 1 so that positive or negative gate-on voltage becomes low as the temperature of the panel becomes high and so that positive or negative gate-on voltage becomes high as the temperature of the panel becomes low. The positive gate-on voltage is set so that it is always higher than the negative gate-on voltage.

Further, for another characteristic, a liquid crystal is driven, correcting the center of common voltage $V_{COM}$ according to relation according to the temperature of a panel shown in a graph in FIG. 3B. That is, the DC/DC converter 4 sets according to a control signal from the temperature detecting circuit 7 shown in FIG. 1 so that the center of $V_{COM}$ becomes high as the temperature of the panel becomes high and the center of $V_{COM}$ becomes low as the temperature of the panel becomes low.

As by such liquid crystal driving, a data signal $V_D$ is turned at an active level only in pulse duration according to displayed gradation, the gate-on voltage of a gate signal $V_G$ supplied according to the polarity of a data signal $V_D$ is differentiated and positive gate-on voltage $V_{GONP}$ is set so that it is larger than negative gate-on voltage $V_{GONN}$, current $I_{ON}$ for turning on the thin-film transistor can be equalized between when positive data is written and when negative data is written and PWM driving in which writing asymmetry is reduced can be realized.

Further, the ON-state current of the thin-film transistor is fixed independent of the variation of the temperature of the panel by driving, performing correction shown in FIGS. 3A and 3B with gate-on voltage and common voltage in the center according to the temperature of the panel, maintaining such relation, and dislocation between the characteristic of displayed gradation and the characteristic of luminance can be reduced. Flickering and burning due to the variation of the temperature of the panel can be reduced. As a result, the variation of the display image quality of the liquid crystal display panel caused by the variation of the temperature of the panel can be reduced.

Particularly, according to the invention, a method of driving a liquid crystal display characterized in that the positive gate-on voltage ($V_{GONP}$) and the negative gate-on voltage ($V_{GONN}$) of a thin-film transistor are set based upon the temperature of a liquid crystal display panel based upon a method of driving an active matrix liquid crystal display for driving a liquid crystal display panel provided with plural thin-film transistors (TFTs) for switching connected to plural pixel electrodes according to a pulse width modulation driving system (hereinafter simply called an active matrix liquid crystal display) is acquired.

Desirably, the center ($V_{COM}$ center) of common voltage supplied to a common electrode of the liquid crystal display panel is also set based upon the temperature of the panel.

Further, the invention is also characterized in that the positive gate-on voltage ($V_{GONP}$) is set so that it is higher than the negative gate-on voltage ($V_{GONN}$) and as the temperature of the panel rises, both the positive gate-on voltage ($V_{GONP}$) and the negative gate-on voltage ($V_{GONN}$) are set so that they are lower than those before the rise of the panel temperature, maintaining the above-mentioned relation.

Besides, a method of driving a liquid crystal display also characterized in that a circuit for setting the positive gate-on voltage ($V_{GONP}$) and the negative gate-on voltage ($V_{GONN}$) of a thin-film transistor for switching so that the ON-state current ($I_{ON}$) of the thin-film transistor for switching is fixed independent of the temperature of a panel is provided based upon a method of driving an active matrix liquid crystal display for driving a liquid crystal display panel provided with plural thin-film transistors for switching connected to plural pixel electrodes according to a data signal pulse width modulation driving system is acquired.

Further, a method of driving a liquid crystal display also characterized in that a thin-film transistor for monitoring formed at the same time as the thin-film transistor for switching is provided to the liquid crystal display panel and a circuit using the thin-film transistor for monitoring for setting the positive gate-on voltage ($V_{GONP}$) and the negative gate-on voltage ($V_{GONN}$) of the thin-film transistor for switching so that the ON-state current ($I_{ON}$) of the thin-film transistor for switching is fixed independent of the temperature of the panel is provided is acquired.

Besides, according to the invention, a method of driving a liquid crystal display characterized in that the positive data pulse width ($T_{WP}$) of the data signal in all displayed gradation is set so that it is longer than the negative data pulse width ($T_{WN}$) and as the temperature of the panel rises, the positive gate-on voltage ($V_{GONP}$) and the negative gate-on voltage ($V_{GONN}$) of the thin-film transistor are set so that they are lower based upon a method of driving an active matrix liquid crystal display is acquired.

Further, the invention is based upon the above-mentioned driving method and is characterized in that the positive data pulse width ($T_{WP}$) and the negative data pulse width ($T_{WN}$) of the data signal allocated to each displayed gradation are set according to the temperature of the liquid crystal display panel.

Beside, a method of driving a liquid crystal display based upon the above-mentioned driving method and characterized in that the positive data pulse width ($T_{WP}$) of the data signal in all displayed gradation is set so that it is longer than the negative data pulse width ($T_{WN}$) and as the temperature of the liquid crystal display panel rises, both the positive data pulse width ($T_{WP}$) and the negative data pulse width ($T_{WN}$) are set so that they are shorter than those before the rise of the panel temperature, maintaining the above-mentioned relation is also acquired.

Further, according to the invention, a method of driving a liquid crystal display based upon the above-mentioned driving method and characterized in that each displayed gradation is represented by the number of clocks, a reference clock signal is counted by a counter, gradation data and the output of the counter are compared and the pulse width ($T_W$) of the data signal is set, temperature detecting means is provided and a frequency of the reference clock signal is variable according to the temperature of the liquid crystal display panel or a frequency of the reference clock signal is set so that the frequency is proportional to the ON-state current ($I_{ON}$) of a thin-film transistor for monitoring using the thin-film transistor for monitoring formed at the same time as the thin-film transistor for switching is also acquired. At this time, it is desirable that the positive gate-on voltage ($V_{GONP}$) is set so that it is higher than the negative gate-on voltage ($V_{GONN}$).

Besides, it is desirable that in the invention, the positive data pulse width ($T_{WP}$) of the data signal in all displayed gradation is set so that it is longer than the negative data pulse width ($T_{WN}$).

Further, according to the invention, it is desirable that as the temperature of the panel rises, the center ($V_{COM}$ center) of common voltage supplied to a common electrode of the liquid crystal display panel is set so that it is higher.

Besides, according to the invention, a liquid crystal display driven by above-mentioned each driving method is also acquired.

BRIEF DESCRIPTION OF THE DRAWINGS

FIG. 3A is a characteristic diagram showing relation for correcting panel temperature between panel temperature and gate-on voltage and FIG. 3B is a characteristic diagram showing relation for correcting panel temperature between panel temperature and the center of common voltage ($V_{COM}$ center);

FIG. 4 is a block diagram for explaining the configuration and a driving method of a liquid crystal display equivalent to a third embodiment of the invention;

DETAILED DESCRIPTION OF THE PREFERRED EMBODIMENTS

Figure 1:
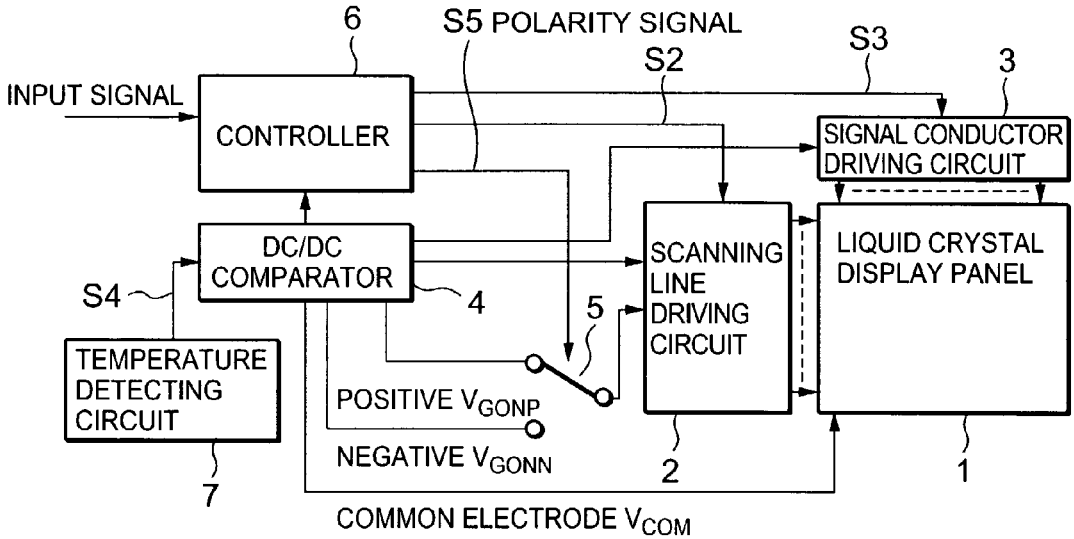
FIG. 1 is a block diagram for explaining the configuration and a driving method of a liquid crystal display equivalent to a first embodiment of the invention.

Next, referring to the drawings, embodiments of the invention will be described in detail. FIG. 1 is a block diagram for explaining the configuration and a driving method of a liquid crystal display equivalent to a first embodiment. The liquid crystal display equivalent to this embodiment is provided with a liquid crystal display panel 1, a scanning line driving circuit 2, a signal conductor driving circuit 3, a DC/DC converter 4, a switch 5, a controller 6 and a temperature detecting circuit 7.

In the liquid crystal display panel 1, plural scanning lines and plural signal conductors respectively crossing each other, plural pixel electrodes arrayed in parts in which these are crossed and each thin-film transistor which is connected to the pixel electrode and which executes switching operation when a gate signal is sent to the scanning line and a data signal is sent to the signal conductor are formed though they are not shown. The scanning line driving circuit 2 supplies a gate signal to the plural scanning lines of the liquid crystal display panel 1. The signal conductor driving circuit 3 supplies a data signal applied to each pixel to the plural signal conductors of the liquid crystal display panel 1.

The DC/DC converter 4 generates and outputs various voltage required for driving a liquid crystal of the liquid crystal display panel 1 based upon supply voltage supplied from an external device. Detailedly, the DC/DC converter 4 outputs positive and negative data voltage $V_D$ for driving the liquid crystal by ac, positive gate-on voltage $V_{GONP}$ output to a certain scanning line by the scanning line driving circuit 2 in duration in which the positive data voltage $V_D$ is supplied, negative gate-on voltage $V_{GONN}$ output to a certain scanning line by the scanning line driving circuit 2 in duration in which the negative data voltage $V_D$ is supplied and common voltage $V_{COM}$ supplied to a common electrode opposite to the pixel electrode of the liquid crystal display panel 1.

The switch 5 is switched when the switch 5 receives a polarity signal S5 switched every vertical term, selects positive or negative gate-on voltage $V_{GONP}$ or $V_{GONN}$ and outputs it to the scanning line driving circuit 2.

The controller 6 receives an input signal from an external device, that is, a picture signal and a control signal such as a horizontal synchronizing signal and a vertical synchronizing signal, outputs control signals S2 and S3 for controlling each operation of the scanning line driving circuit 2 and the signal conductor driving circuit 3 to enable gradation display according to the input signal and also outputs the polarity signal S5 for controlling. the switching of the switch 5.

The temperature detecting circuit 7 detects the temperature of the liquid crystal display panel 1 and outputs a control signal S4 to the DC/DC converter 4. In this embodiment, a case that the detecting circuit 7 is bonded on the outside surface of the liquid crystal display panel 1 is supposed.

Voltage applied to the liquid crystal is proportional to the product of the ON-state current of the thin-film transistor and data pulse width. There is correlation of simple increase between the gate-on voltage and the ON-state current of the thin-film transistor. In this embodiment, the liquid crystal is driven, correcting gate-on voltage according to relation shown in a graph for correction showing the relation between gate-on voltage and panel temperature in FIG. 3A. That is, the DC/DC converter 4 sets according to the control signal S4 from the temperature detecting circuit 7 so that the higher panel temperature is, the lower positive or negative gate-on voltage is and the lower panel temperature is, the higher positive or negative gate-on voltage is. The positive gate-on voltage is set so that it is always higher than the negative gate-on voltage.

Further, in this embodiment, the liquid crystal is driven, correcting the center ($V_{COM}$ center) of common voltage according to relation shown in a graph for correction showing the relation between $V_{COM}$ center and panel temperature in FIG. 3B. That is, the DC/DC converter 4 sets according to the control signal S4 from the temperature detecting circuit 7 so that the higher the temperature of the panel is, the higher $V_{COM}$ center is and the lower the temperature of the panel is, the lower $V_{COM}$ center is.

Figure 2:
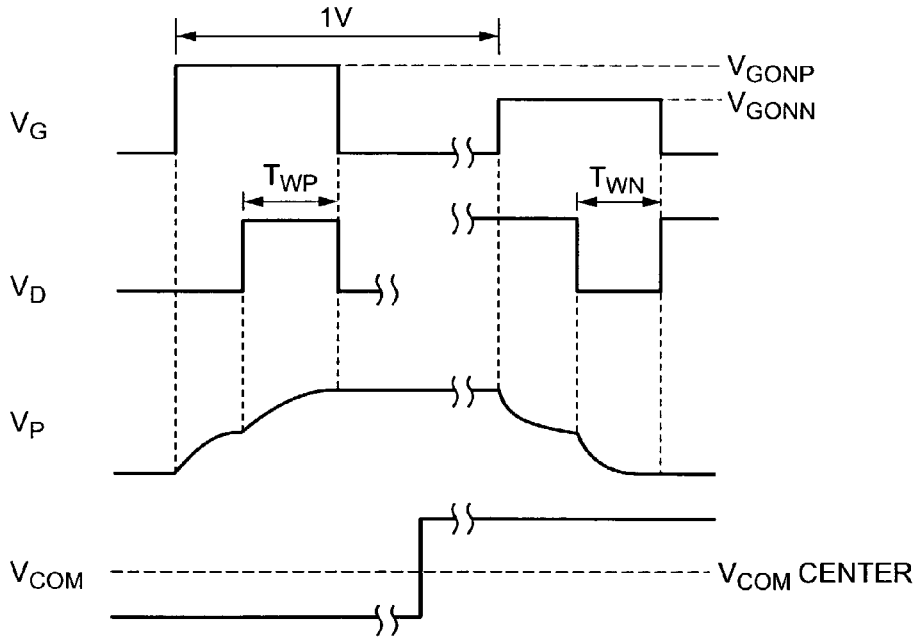
FIG. 2 is a timing chart showing the variation of applied voltage VP applied to one pixel electrode of the liquid crystal display according to a PWM driving system shown in FIG. 1.

Next, referring to FIG. 2, the driving method equivalent to this embodiment will be described. FIG. 2 is a timing chart showing the variation of applied voltage $V_P$ applied to one pixel electrode of the liquid crystal display according to the PWM driving system shown in FIG. 1. When a gate signal $V_G$ applied to the scanning line becomes a high level $V_{GONP}$ while a data signal $V_D$ applied to the signal conductor in certain one vertical duration (1V) is at a positive reference level, the thin-film transistor is turned on, applied voltage $V_P$ is increased in accordance with the data signal $V_D$ at the positive reference level and further, when the data signal $V_D$ becomes a positive active level, applied voltage $V_P$ is increased in accordance with the data signal $V_D$ only in a term $T_{WP}$ of pulse width determined according to displayed gradation. Next, when the gate signal $V_G$ becomes a low level, the thin-film transistor is turned off and applied voltage $V_P$ is held in well-known storage capacity (not shown) provided for active matrix operation at this time. In this vertical duration, a low level determined according to the center $V_{COM}$ center of an amplitude is supplied to the common electrode.

When the gate signal $V_G$ applied to the scanning line becomes a negative high level $V_{GONN}$ lower than the positive high level $V_{GONP}$ while the data signal $V_D$ applied to the signal conductor in the next one vertical duration is at a negative reference level, the thin-film transistor is turned on, applied voltage $V_P$ is decreased in accordance with the data signal $V_D$ at the negative reference level and further, when the data signal $V_D$ becomes a negative active level, applied voltage $V_P$ is further decreased in accordance with the data signal $V_D$ only in a term $T_{WN}$ of pulse width determined according to displayed gradation. Next, when the gate signal $V_G$ becomes a low level, the thin-film transistor is turned off and applied voltage $V_P$ at this time is held. In this one vertical duration, a high level determined according to the center $V_{COM}$ center of the amplitude is supplied to the common electrode.

Next, a second embodiment of the invention will be described. Voltage applied to a liquid crystal is proportional to the product of the ON-state current of a thin-film transistor and data pulse width. This embodiment is characterized in that data pulse width $T_W$ is corrected according to the polarity of write data and the corrected quantity is varied according to the temperature of a panel. For example, PWM driving in which the written quantity of positive data and the written quantity of negative data are equalized and the asymmetrical property of writing is reduced can be realized by setting so that the data pulse width $T_{WP}$ of positive write data is wider than the data pulse width $T_{WN}$ of negative write data, in other words, so that the data pulse width $T_{WN}$ of negative write data is narrower than the data pulse width $T_{WP}$ of positive write data.

Further, the written quantity can be fixed independent of the variation of the panel temperature by setting so that the data pulse width $T_{WP}$ of positive write data and the data pulse width $T_{WN}$ of negative write data are both narrower as the temperature of the panel rises, maintaining the above-mentioned relation, and dislocation between the characteristic of gradation and the characteristic of luminance can be reduced. As a result, the variation of the quality of an image displayed on the liquid crystal display panel can be reduced independent of the variation of the panel temperature, and flickering and burning can be reduced independent of the variation of the panel temperature. Therefore, the above-mentioned effect can be acquired, realizing multi-gradation display using a gradation voltage generating circuit having simple configuration which is a characteristic of PWM driving.

Next, a third embodiment of the invention will be described. FIG. 4 is a block diagram for explaining the configuration of a liquid crystal display equivalent to this embodiment and a method of driving it. The temperature detecting circuit 7 in the above-mentioned first embodiment is provided outside the liquid crystal display panel to detect the temperature of the liquid crystal display panel. In the meantime, this embodiment is characterized in that temperature detecting means 8 for detecting the temperature of a panel is provided inside the liquid crystal display panel 1.

Figure 5:
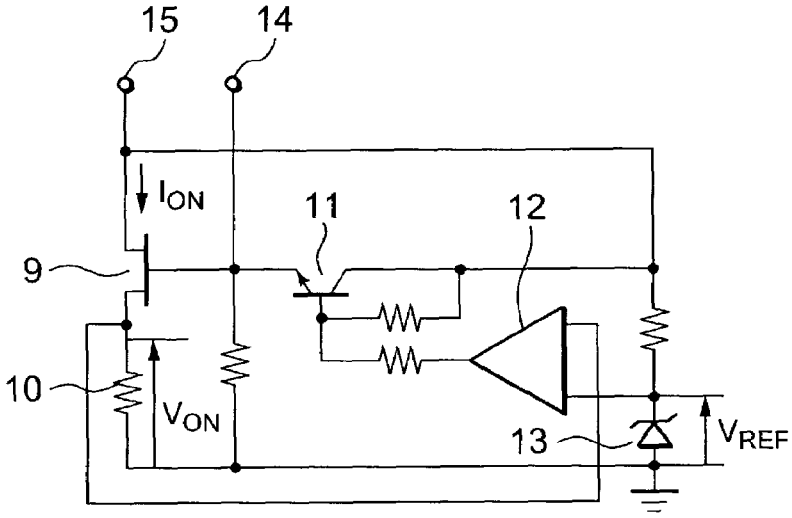
FIG. 5 is a circuit diagram for explaining an example of the circuit configuration of temperature detecting means 8 according to the invention.
Figure 6:
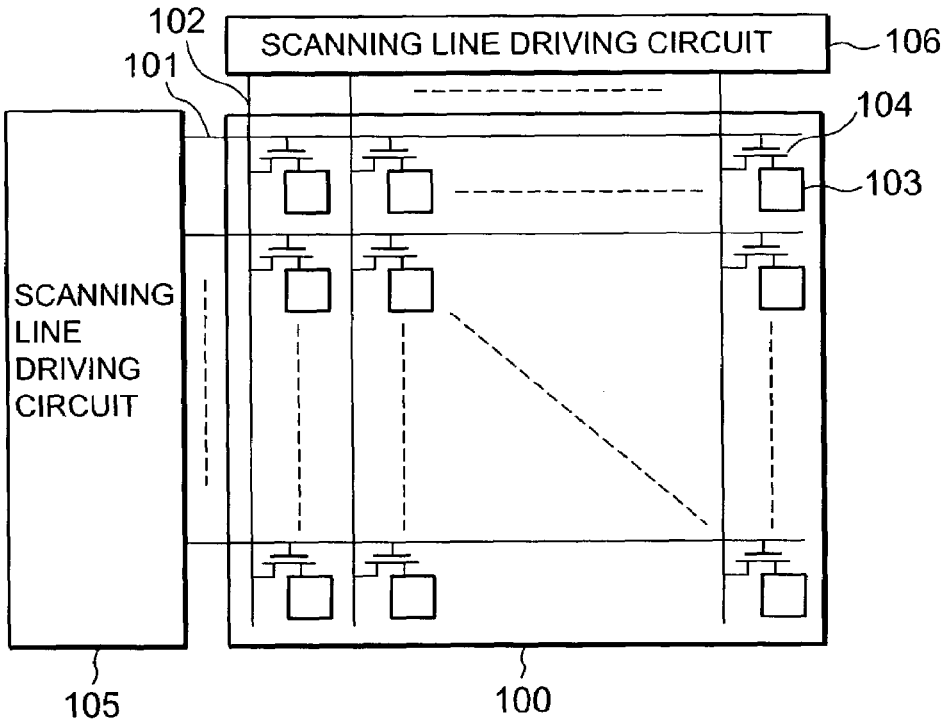
FIG. 6 (PRIOR ART)
FIG. 6 is a block diagram showing a main part of a conventional type liquid crystal display.
Figure 7:
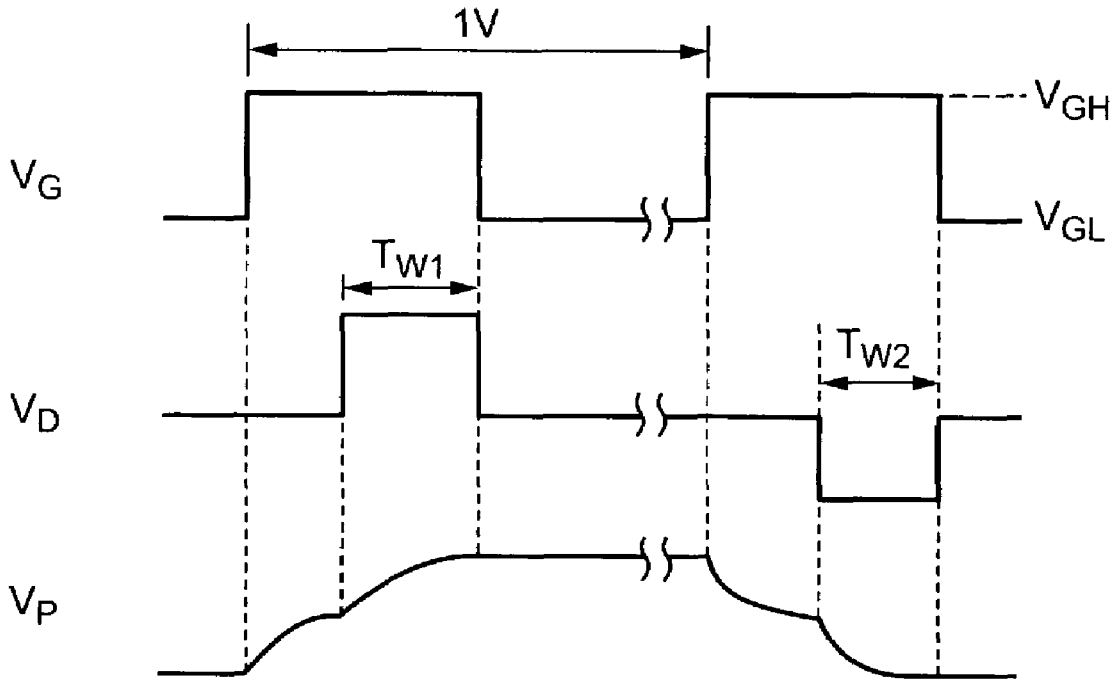
FIG. 7 (PRIOR ART)
FIG. 7 is a timing chart showing the variation of applied voltage $V_P$ applied to a certain pixel electrode 103 of the liquid crystal display according to a PWM driving system shown in FIG. 6.

For example, a thin-film transistor for monitoring is formed at the same time as a thin-film transistor for switching pixels, the ON-state current $I_{ON}$ (or a parameter related to this) of the thin-film transistor for monitoring is detected and gate-on voltage $V_{GON}$ is set so that it is fixed independent of the temperature of the panel. FIG. 5 is a circuit diagram for explaining the circuit configuration of such temperature detecting means 8. As shown in FIG. 5, power is supplied from a terminal 15. A thin-film transistor for monitoring 9 is provided inside a liquid crystal display panel 1, amplifies difference between voltage $V_{ON}$ determined by ON-state current when the thin-film transistor for monitoring 9 is turned on and reference voltage $V_{REF}$ (output by a reference voltage source composed of a resistor R13 and Zener diode 13), controls a control transistor 11, feedbacks to the gate of the thin-film transistor for monitoring 9 to fix the ON-state current and outputs a correction signal to a terminal 14. The correction signal is output to a DC/DC converter 4. The center $V_{COM}$ center of common voltage is also corrected according to the temperature.

In this embodiment, as the thin-film transistor for monitoring is provided inside the liquid crystal display panel 1 and the temperature of the panel can be detected in a location nearer to a liquid crystal, more precise correction can be realized, compared with the correction in the first embodiment. The circuit configuration except the thin-film transistor of the temperature detecting means 8 in this embodiment may be also arranged outside the liquid crystal display panel, system on glass (SOG) technology is adopted and the temperature detecting means may be also formed inside the liquid crystal display panel at the same time as the thin-film transistor for switching pixels.

Next, a fourth embodiment of the invention will be described. In a liquid crystal display according to a PWM driving system, a reference clock signal is counted by a counter, gradation data and the output of the counter are compared and the pulse width $T_W$ of write data corresponding to displayed gradation is set. This embodiment is characterized in that a frequency of the reference clock signal is varied according to the temperature of a panel. For example, as the pulse width $T_W$ of write data is narrowed by setting the frequency of the reference clock signal so that it is high and the pulse width $T_W$ of write data is widened by setting the frequency so that it is low, this embodiment is applied to the liquid crystal display described in the second embodiment where the data pulse width $T_W$ is corrected according to the temperature of the panel and the polarity of write data.

PWM driving in which dislocation according to the variation of the panel temperature between the characteristic of gradation and the characteristic of luminance and the asymmetrical property of writing are reduced can be realized by setting the data pulse width $T_{WP}$ of positive write data so that it is wider than the data pulse width $T_{WN}$ of negative write data, varying the frequency of the reference clock signal according to the temperature of the panel and setting the pulse width $T_W$ of write data.

The frequency of the reference clock signal may be also set using a thin-film transistor for monitoring formed at the same time as a thin-film transistor for switching pixels so that the frequency is proportional to the ON-state current $I_{ON}$ Of the thin-film transistor for monitoring.

The Preferred embodiments have been described, however, the invention is not limited to the embodiments and various variations, addition and the combination of the embodiments are allowed. For the temperature detecting means, a thermistor can be also used. For an example in which the thermistor is used for a temperature detecting circuit forming the temperature detecting means, configuration mainly formed by a voltage setting circuit shown in FIG. 2 in Japanese published unexamined patent application No. Hei6-138843 can be also used. Not the thermistor but another temperature detecting means such as a thermocouple can be also adopted.

In the above-mentioned embodiments, the concrete configuration of the liquid crystal display panel has not referred, however, in case a transmission type liquid crystal display panel is used, the temperature detecting means can be formed on the panel as in the third embodiment and for example, it is desirable that the temperature detecting means is formed in a peripheral area around a display area in the panel. Thereby, high-luminance liquid crystal display can be realized, preventing outgoing light from a backlight unit arranged on the back side of the liquid crystal display panel when the panel is viewed from a user from being intercepted.

In the case of a reflection type liquid crystal display panel, temperature detecting means can be formed on the panel as in the third embodiment and may be also arranged on the back side of the liquid crystal display pane. In the case of the reflection type liquid crystal display panel, the arrangement of the temperature detecting means on the back side has no effect upon display characteristics. The temperature detecting means can be formed in a peripheral area in the panel and also in a display area according to circumstances. In the reflection type liquid crystal display panel, pixel electrodes which also function as a reflector are arrayed in the display area and each pixel electrode covers the top of the thin-film transistor for switching pixels. In case the thin-film transistor for monitoring is arranged under the pixel electrode as the thin-film transistor for switching pixels, it can be also arranged in the display area without deteriorating display characteristics.

In the case of a semi-transmission type liquid crystal display panel, if temperature detecting means is arranged under a pixel electrode in a reflecting part out of a transmission part and the reflecting part, the temperature detecting means can be arranged in a display area without deteriorating display characteristics.

The temperature detecting circuit may be formed not only by SOG technology but by chip on glass (COG) technology. Furthermore, control over correction according to in-plane temperature distribution in the panel can be also executed by making the temperature detecting means detect the temperature of the panel in plural locations of the liquid crystal display panel.

For the method of driving the liquid crystal display panel, frame inversion driving shown in FIG. 2 in which the polarity of a data signal is inverted every vertical duration (1V) and gate inversion driving in which the polarity of a data signal is inverted every horizontal duration (1 H) and further, the polarity is inverted every vertical duration (1V) may be also used.

According to the invention, as the data signal $V_D$ is turned at the active level only in pulse duration according to displayed gradation, the gate-on-voltage $V_{GONP}$ and the gate-on voltage $V_{GONN}$ of the gate signal $V_G$ supplied according to the polarity of the data signal $V_D$ are differentiated and the gate-on voltage $V_{GONP}$ is set so that it is larger than the gate-on voltage $V_{GONN}$, the ON-state current $I_{ON}$ of the thin-film transistor can be equalized between when positive data is written and when negative data is written and PWM driving in which the asymmetrical property of writing is reduced can be realized.

Further, the ON-state current of the thin-film transistor is fixed independent of the variation of the panel temperature by driving, performing correction shown in FIGS. 3A and 3B with gate-on voltage and common voltage in the center according to the temperature of the panel, maintaining the above-mentioned relation, and dislocation between the characteristic of gradation and the characteristic of luminance can be reduced. As a result, the variation of the quality of an image displayed on the liquid crystal display panel can be reduced independent of the variation of the panel temperature. As the corrected quantity of positive gate-on voltage and the corrected quantity of negative gate-on voltage can be adjusted according to the temperature of the panel, flickering and burning respectively caused by the variation of the panel temperature can be inhibited. Therefore, the above-mentioned effect can be acquired using the gradation voltage generating circuit having simple configuration which is the characteristic of PWM driving, realizing multi-gradation display.

What is claimed is:

1. A method of driving a liquid crystal display panel comprising plural pixel electrodes connected to plural thin-film transistors for switching that are switched according to a pulse width modulation driving system, wherein:

a positive gate-on voltage ($V_{GONP}$) and a negative gate-on voltage ($V_{GONN}$) of the thin-film transistors are set based upon the temperature of the liquid crystal display panel, wherein the positive gate-on voltage ($V_{GONP}$) is set so that it is higher than the negative gate-on voltage ($V_{GONN}$); and as the temperature of the liquid crystal display panel rises, both the positive gate-on voltage ($V_{GONP}$) and the negative gate-on voltage ($V_{GONN}$) are set so that they are lower than before the rise of the panel temperature, while maintaining the relationship therebetween.

2. A method of driving a liquid crystal display panel comprising plural pixel electrodes connected to plural thin-film transistors for switching that are switched according to a pulse width modulation driving system, wherein the method comprises:

setting a positive gate-on voltage ($V_{GONP}$) and a negative gate-on voltage ($V_{GONN}$) of the thin-film transistors based upon the temperature of the liquid crystal display panel, wherein the positive gate-on voltage ($V_{GONP}$) and the negative gate-on voltage ($V_{GONN}$) of the thin-film transistors are set so that the ON-state current ($I_{ON}$) of the thin-film transistors is fixed independent of the temperature of the panel; and using the pulse width modulation driving system for modulating the pulse width of a data signal.

3. The method of driving a liquid crystal display according to claim 2, wherein:

a positive data pulse width ($T_{WP}$) of the data signal in all displayed gradations is set so that it is longer than a negative data pulse width ($T_{WN}$) of the data signal; and as the temperature of the panel rises, the positive gate-on voltage ($V_{GONP}$) and the negative gate-on voltage ($V_{GONN}$) of the thin-film transistor are set so that they are lower.

4. The method of driving a liquid crystal display according to claim 2, wherein a positive data pulse width ($T_{WP}$) and a negative data pulse width ($T_{WN}$) of the data signal allocated to each displayed gradation are set according to the temperature of the liquid crystal display panel.

5. The method of driving a liquid crystal display according to claim 2, wherein:

a positive data pulse width ($T_{wp}$) of the data signal in all displayed gradations is set so that it is longer than a negative data pulse width ($T_{WN}$) of the data signal; and as the temperature of the liquid crystal display panel rises, both the positive data pulse width ($T_{WP}$) and the negative data pulse width ($T_{WN}$) are set to be shorter than their respective pulse widths before the rise of the panel temperature, while maintaining the relationship therebetween.

6. The method of driving a liquid crystal display according to claim 2, wherein a positive data pulse width ($T_{WP}$) of the data signal in all displayed gradations is set so that it is longer than a negative data pulse width ($T_{WN}$) of the data signal.

7. A method of driving a liquid crystal display comprising plural pixel electrodes connected to plural thin-film transistors for switching that are switched according to a pulse width modulation driving system and a thin-film transistor for monitoring formed at the same time as the thin-film transistors for switching and disposed on the liquid crystal display panel, wherein the method comprises:

setting a positive gate-on voltage ($V_{GONP}$) and a negative gate-on voltage ($V_{GONN}$) of the thin-film transistors based upon the temperature of the liquid crystal display panel;

using the pulse width modulation driving system for modulating the pulse width of a data signal; and using the thin-film transistor for monitoring for setting the positive gate-on voltage ($V_{GONP}$) and the negative gate-on voltage ($V_{GONN}$) of the thin-film transistors for switching so that the ON-state current ($I_{ON}$) of the thin-film transistors for switching.

8. The method of driving a liquid crystal display according to claim 7, wherein a positive data pulse width ($T_{WP}$) of the data signal in all displayed gradations is set so that it is longer than a negative data pulse width ($T_{WN}$) of the data signal.

9. The method of driving a liquid crystal display according to claim 7, wherein:

a positive data pulse width ($T_{WP}$) of the data signal in all displayed gradations is set so that it is longer than a negative data pulse width ($T_{WN}$) of the data signal; and as the temperature of the panel rises, the positive gate-on voltage ($V_{GONP}$) and the negative gate-on voltage ($V_{GONN}$) of the thin-film transistor are set so that they are lower.

10. The method of driving a liquid crystal display according to claim 7, wherein a positive data pulse width ($T_{WP}$) and a negative data pulse width ($T_{WN}$) of the data signal allocated to each displayed gradation are set according to the temperature of the liquid crystal display panel.

11. The method of driving a liquid crystal display according to claim 7, wherein:

a positive data pulse width ($T_{wp}$) of the data signal in all displayed gradations is set so that it is longer than a negative data pulse width ($T_{WN}$) of the data signal; and as the temperature of the liquid crystal display panel rises, both the positive data pulse width ($T_{WP}$) and the negative data pulse width ($T_{WN}$) are set to be shorter than their respective pulse widths before the rise of the panel temperature, while maintaining the relationship therebetween.

12. A method of driving a liquid crystal display panel comprising plural pixel electrodes connected to plural thin-film transistors for switching that are switched according to a pulse width modulation driving system, wherein the method comprises:

setting a positive gate-on voltage ($V_{GONP}$) and a negative gate-on voltage ($V_{GONN}$) of the thin-film transistors based upon a temperature of the liquid crystal display panel;

using the pulse width modulation driving system for modulating the pulse width of a data signal, wherein:

each displayed gradation is represented by the number of clocks;

a reference clock signal is counted by a counter;

gradation data and the output of the counter are compared and the pulse width ($T_W$) of the data signal is set; and a frequency of the reference clock signal is varied according to the temperature of the liquid crystal display panel provided by a temperature detecting means.

13. The method of driving a liquid crystal display according to claim 12, wherein the positive gate-on voltage ($V_{GONP}$) is set so that it is higher than the negative gate-on voltage ($V_{GONN}$).

14. The method of driving a liquid crystal display according to claim 12, wherein a positive data pulse width ($T_{WP}$) of the data signal in all displayed gradations is set so that it is longer than a negative data pulse width ($T_{WN}$) of the data signal.

15. A method of driving a liquid crystal display panel comprising plural pixel electrodes connected to plural thin-film transistors for switching that are switched according to a pulse width modulation driving system, wherein the method comprises:

setting a positive gate-on voltage ($V_{GONP}$)and a negative gate-on voltage ($V_{GONN}$) of the thin-film transistors based upon a temperature of the liquid crystal display panel;

using the pulse width modulation driving system for modulating the pulse width of a data signal, wherein:

each displayed gradation is represented by the number of clocks;

a reference clock signal is counted by a counter;

gradation data and the output of the counter are compared and the pulse width ($T_W$) of the data signal is set; and a frequency of the reference clock signal is set using a thin-film transistor for monitoring formed at the same time as the thin-film transistors for switching so that the frequency is proportional to the ON-state current ($I_{ON}$) of the thin-film transistor for monitoring.

16. The method of driving a liquid crystal display according to claim 15, wherein the positive gate-on voltage ($V_{GONP}$) is set so that it is higher than the negative gate-on voltage ($V_{GONN}$).

17. The method of driving a liquid crystal display according to claim 15, wherein a positive data pulse width ($T_{WP}$) of the data signal in all displayed gradations is set so that it is longer than a the-negative data pulse width ($T_{WN}$) of the data signal.

18. A method of driving a liquid crystal display panel comprising plural pixel electrodes connected to plural thin-film transistors for switching that are switched according to a pulse width modulation driving system, wherein:

a positive gate-on voltage ($V_{GONP}$) and a negative gate-on voltage ($V_{GONN}$) of the thin-film transistors are set based upon the temperature of the liquid crystal display panel; and as the temperature of the liquid crystal display panel rises, the center ($V_{COM}$ center) of common voltage supplied to a common electrode of the liquid crystal display panel is made higher.

* * * * *